US005896627A

United States Patent [19]

Cappel et al.

[11] Patent Number: 5,896,627

[45] Date of Patent: Apr. 27, 1999

[54] HIGH-STRENGTH SLIDER FOR A RECLOSABLE BAG

[75] Inventors: Craig E. Cappel, Rochester; Toby R. Thomas, Pittsford, both of N.Y.

[73] Assignee: Tenneco Packaging Inc., Lake Forest, Ill.

[21] Appl. No.: 08/938,047

[22] Filed: Sep. 26, 1997

[51] Int. Cl.[6] ..... A44B 19/16

[52] U.S. Cl. ..... 24/400

[58] Field of Search ..... 383/63, 69, 64; 24/30.5 R, 399, 587, 400, 427

[56] References Cited

U.S. PATENT DOCUMENTS

| | | | |
|---|---|---|---|
| 4,262,395 | 4/1981 | Kosky | 24/400 |
| 4,392,897 | 7/1983 | Herrington | 156/66 |
| 4,410,130 | 10/1983 | Herrington | 383/62 |
| 4,415,087 | 11/1983 | Clayton et al. | 206/632 |
| 4,419,159 | 12/1983 | Herrington | 156/66 |
| 4,519,095 | 5/1985 | Clayton | 383/86 |
| 4,561,109 | 12/1985 | Herrington | 383/65 |
| 4,603,434 | 7/1986 | Herrington | 383/95 |
| 4,618,383 | 10/1986 | Herrington | 156/66 |
| 4,787,754 | 11/1988 | Herrington | 383/63 |
| 5,007,142 | 4/1991 | Herrington | 24/400 |
| 5,007,143 | 4/1991 | Herrington | 24/400 |
| 5,010,627 | 4/1991 | Herrington et al. | 24/400 |
| 5,020,194 | 6/1991 | Herrington et al. | 24/400 |
| 5,063,644 | 11/1991 | Herrington et al. | 24/400 |
| 5,067,208 | 11/1991 | Herrington, Jr. et al. | 24/400 |
| 5,070,583 | 12/1991 | Herrington | 24/400 |
| 5,088,971 | 2/1992 | Herrington | 493/203 |
| 5,131,121 | 7/1992 | Herrington, Jr. et al. | 24/436 |
| 5,152,613 | 10/1992 | Herrington, Jr. | 383/63 |
| 5,161,286 | 11/1992 | Herrington, Jr. et al. | 24/387 |
| 5,189,764 | 3/1993 | Herrington et al. | 24/387 |
| 5,283,932 | 2/1994 | Richardson et al. | 24/400 |
| 5,301,394 | 4/1994 | Richardson et al. | 24/399 |
| 5,301,395 | 4/1994 | Richardson et al. | 24/400 |
| 5,405,478 | 4/1995 | Richardson et al. | 156/308 |
| 5,426,830 | 6/1995 | Richardson et al. | 24/430 |
| 5,431,760 | 7/1995 | Donovan | 156/66 |
| 5,442,837 | 8/1995 | Morgan | 24/400 |
| 5,442,838 | 8/1995 | Richardson et al. | 24/402 |
| 5,448,807 | 9/1995 | Herrington, Jr. | 24/399 |
| 5,448,808 | 9/1995 | Gross | 24/400 |
| 5,482,375 | 1/1996 | Richardson et al. | 383/64 |
| 5,517,733 | 5/1996 | Chao | 24/427 |
| 5,669,715 | 9/1997 | Dobreski et al. | 383/5 |
| 5,682,730 | 11/1997 | Dobreski | 53/469 |
| 5,713,669 | 2/1998 | Thomas et al. | 383/204 |

FOREIGN PATENT DOCUMENTS

| | | |
|---|---|---|
| WO 95/35046 | 12/1995 | WIPO . |
| WO 95/35047 | 12/1995 | WIPO . |
| WO 95/35048 | 12/1995 | WIPO . |

*Primary Examiner*—James R. Brittain
*Attorney, Agent, or Firm*—Arnold, White & Durkee

[57] ABSTRACT

A slider is disclosed for straddling relation with a profiled plastic zipper of a reclosable bag. The zipper has first and second interlocking profiles, and the straddling slider closes and opens the interlocking profiles by movement along the zipper. The slider includes a transverse support member and a pair of side walls extending downward from opposing sides of the support member. The side walls forming respective first and second shoulders extending inwardly toward each other. The first and second shoulders include respective first and second innermost ends facing and contacting respective adjacent portions of the reclosable bag below the respective first and second interlocking profiles. The first and second innermost ends define a tortuous path therebetween, and the adjacent portions of the reclosable bag pass through said tortuous path. The tortuous path is created by protrusions formed by at least one of the innermost ends.

17 Claims, 5 Drawing Sheets

HIGH-STRENGTH SLIDER FOR A RECLOSABLE BAG

FIELD OF THE INVENTION

The present invention generally relates to plastic sliders for opening and closing zippers of reclosable plastic bags and, more particularly, relates to a highstrength plastic slider that is difficult to separate or pry loose from a zipper on which it has been mounted.

BACKGROUND OF THE INVENTION

Reclosable plastic bags with sliders for operating the zippers of these bags are commonly used in various packaging applications. The zipper typically includes male and female tracks forming respective interlocking profiles. In the manufacture of a thermoplastic bag, the male and female tracks extend along the mouth of the bag and are adapted to be secured in any suitable manner to respective opposing flexible panels of the bag. The male and female tracks may be integral marginal portions of these flexible panels or they may be extruded separately and thereafter attached to the flexible panels along the mouth of the bag. The slider, which is mounted to the zipper, is used to open and close the zipper. When the slider is in a closed position, the profiles are interlocked with each other. In response to moving the slider to an open position, the profiles are disengaged from each other.

One example of a slider for operating a zipper of a reclosable bag is depicted in FIGS. 1 and 2. This slider 10 includes a transverse support member 12, a pair of legs 14*a* and 14*b*, and a pair of wings 16*a* and 16*b*. The pair of legs 14*a* and 14*b* extend downward from opposing sides of the support member 12. The pair of wings 16*a* and 16*b* are hingedly connected to the opposing sides of the support member 12 and, when the slider 10 is mounted to the zipper as shown in FIG. 1, the wings 16*a* and 16*b* extend downward from the opposing sides of the support member 12. To secure the slider 10 to the zipper after it has been mounted thereto, the wings 16*a* and 16*b* form respective shoulders 18*a* and 18*b* (see FIG. 2). The shoulders 18*a* and 18*b* extend inwardly toward each other and contact respective adjacent portions of the bag below their respective profiles 20*a* and 20*b*, thereby retaining the slider on the zipper.

FIG. 2 is a bottom view of the slider 10 mounted to the zipper. It can be seen that the gap $D_1$ between the inwardly extending shoulders 18*a* and 18*b* is smaller than the distance $D_2$ between the outermost portions of the interlocking profiles 20*a* and 20*b*. As a result, the shoulders 18*a* and 18*b* effectively maintain the slider 10 in mounting relationship with the zipper. Extremely high forces are required to separate the mounted slider 10 from the zipper. However, such forces could occur if, for example, the contents of the bag are extremely heavy and a user attempts to lift the bag by the slider alone. The present invention makes it more difficult to separate the slider from the zipper.

SUMMARY OF THE INVENTION

An object of the present invention to provide a high-strength plastic slider for a reclosable bag that is difficult to separate or pry loose from a zipper on which it has been mounted.

These and other objects are realized by providing a slider with specially designed shoulders for more effectively retaining the slider on the zipper. The slider includes a transverse support member and a pair of side walls extending downward from opposing sides of the support member. The side walls form respective first and second shoulders that extend inwardly toward each other. The first and second shoulders include respective first and second innermost ends that face and contact respective adjacent portions of the bag below their respective interlocking profiles.

The first innermost end of the first shoulder includes a first non-planar section having a first protruding portion and a first recessed portion. The first protruding portion juts further inward toward the respective adjacent bag portion than a remainder of the first innermost end of the first shoulder. Likewise, the second innermost end of the second shoulder preferably includes a second non-planar section having a second protruding portion and a second recessed portion. The second protruding portion juts further inward toward the respective adjacent bag portion than a remainder of the second innermost end of the second shoulder. The first non-planar section is preferably complementary to the second non-planar section such that the first protruding portion opposes the second recessed portion and the first recessed portion opposes the second protruding portion. The first and second non-planar sections effectively strengthen the retention of the slider on the zipper, thereby making it more difficult to remove the slider from the zipper.

BRIEF DESCRIPTION OF THE DRAWINGS

Other objects and advantages of the invention will become apparent upon reading the following detailed description and upon reference to the drawings in which.

Figure 1:
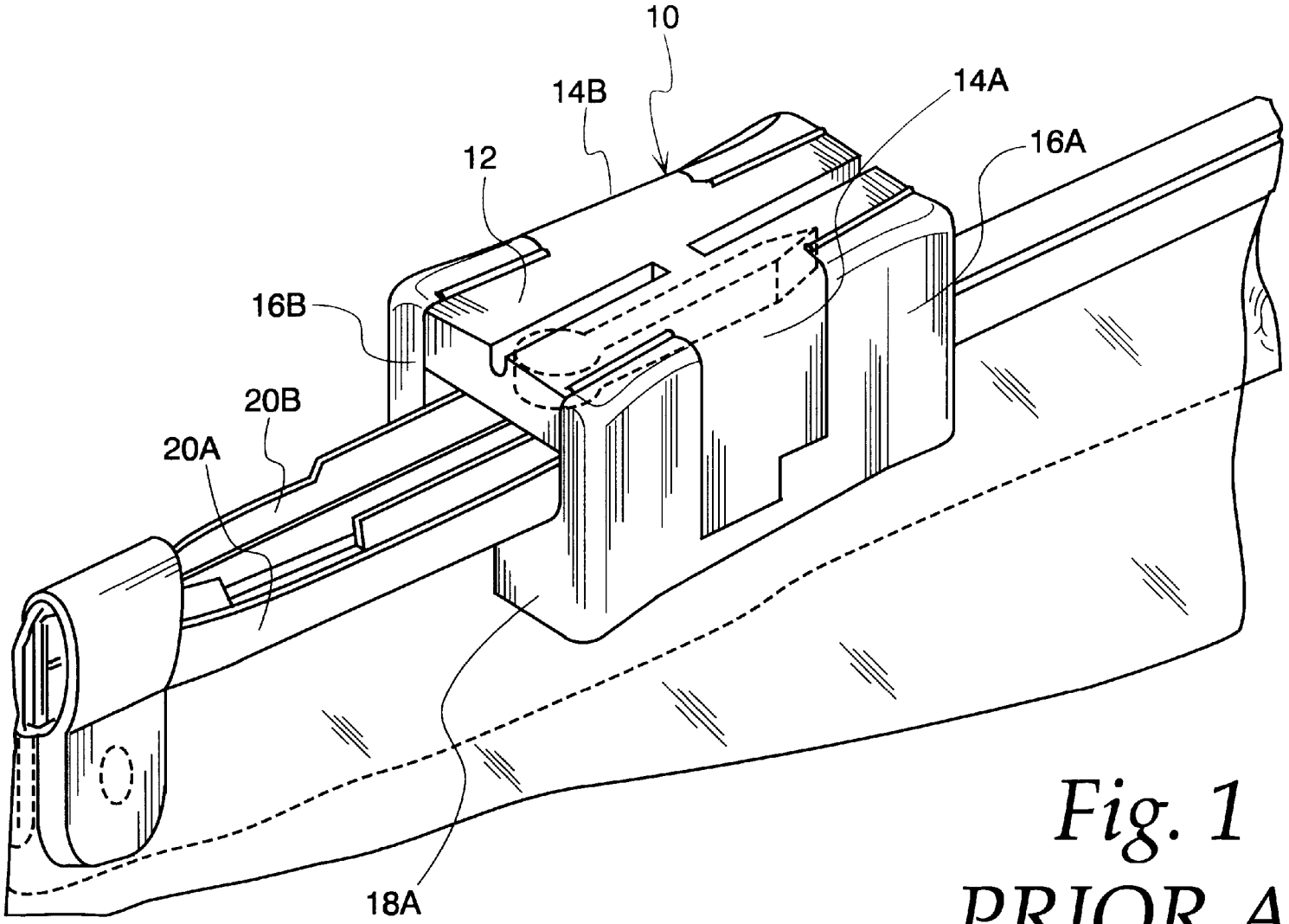
Fig. 1 PRIOR ART
FIG. 1 is an isometric view of a prior art plastic slider mounted to a zipper of a reclosable bag.
Figure 2:
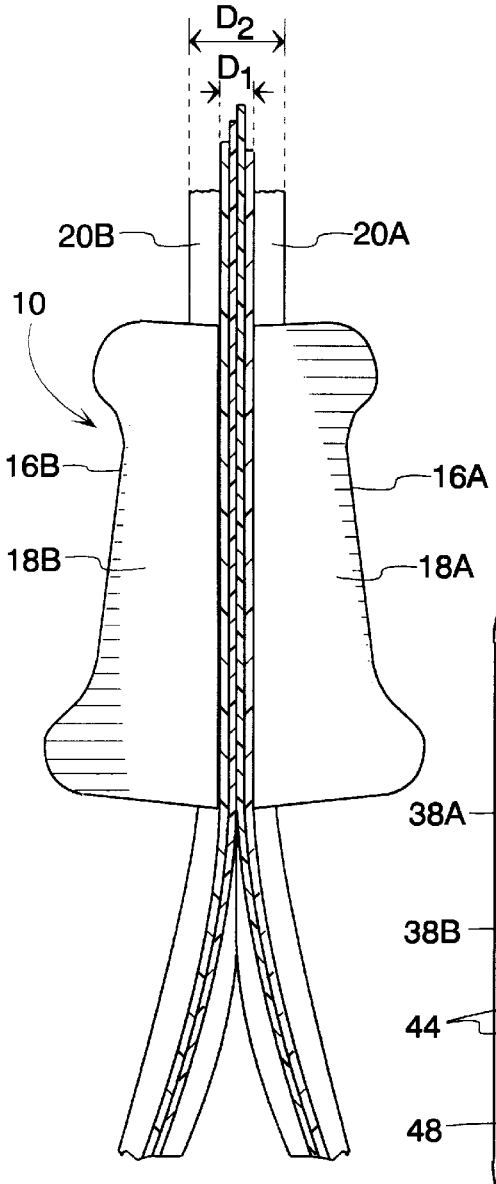
Fig. 2 PRIOR ART
FIG. 2 is a bottom view of the slider of FIG. 1 showing shoulders of the slider in engagement with interlocking profiles of the zipper.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

PREFERRED EMBODIMENT OF THE INVENTION

Figure 3:
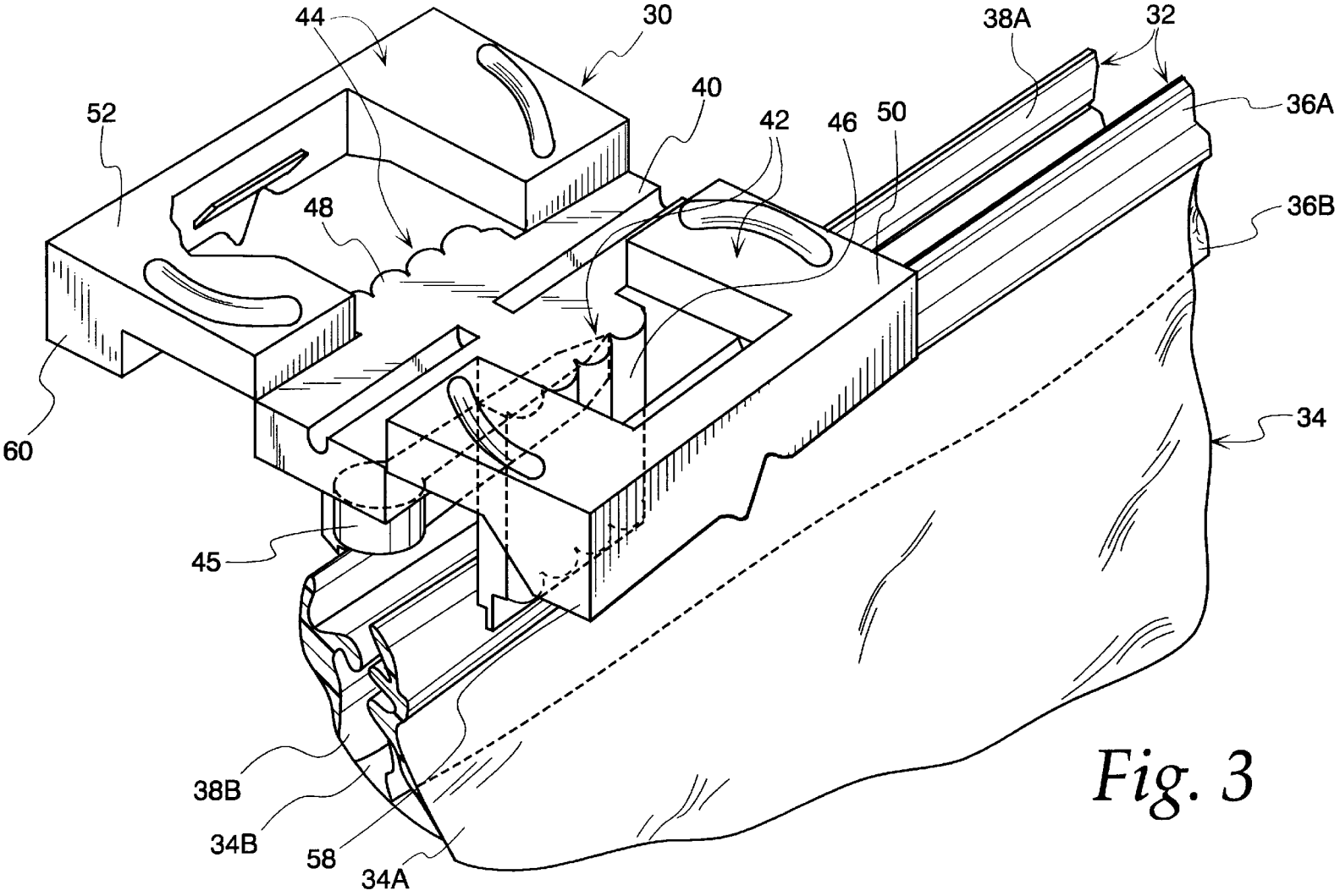
FIG. 3 is an isometric view of a slider embodying the present invention before it has been mounted to a zipper of a reclosable bag.
Figure 4:
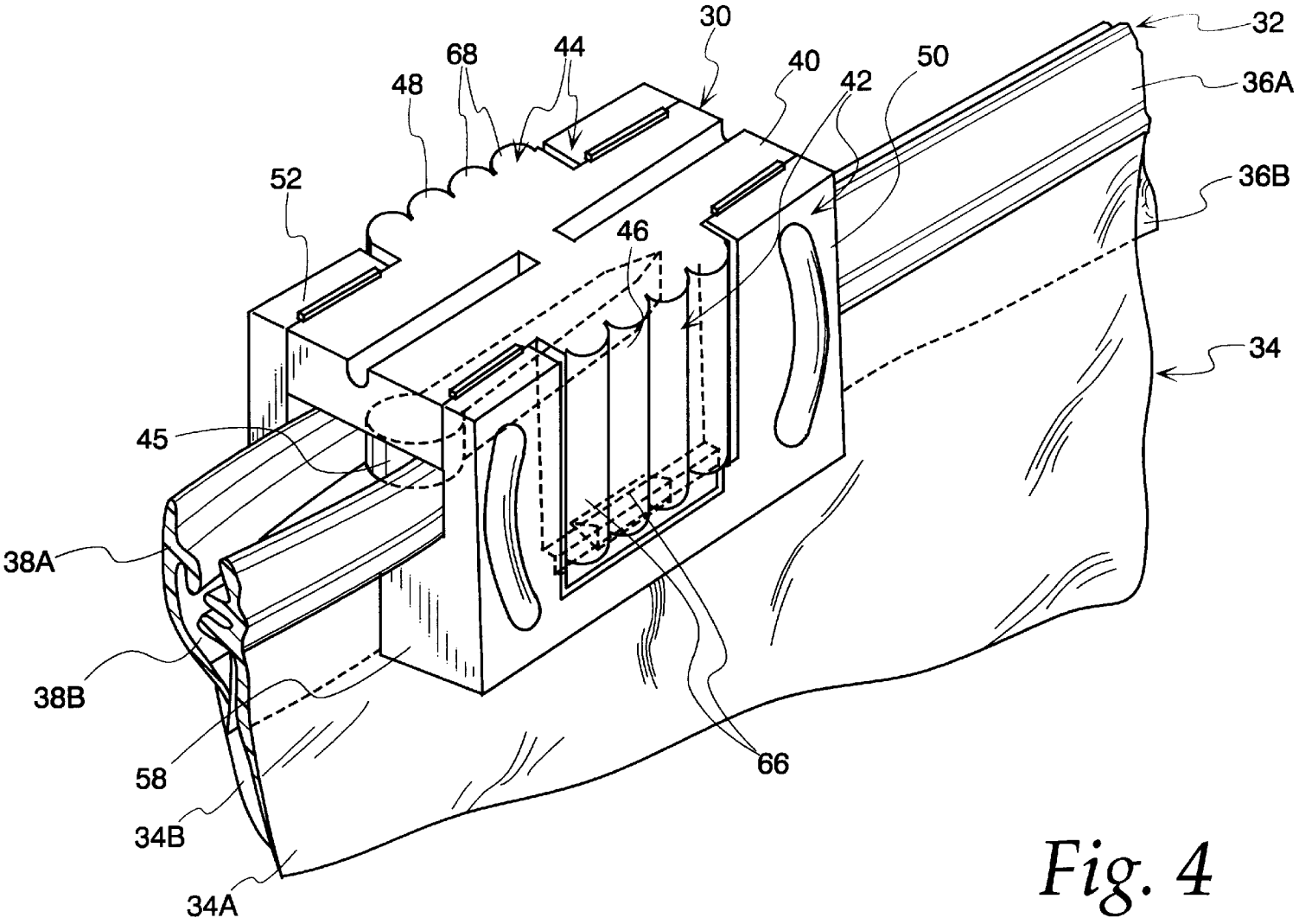
FIG. 4 is an isometric view of the slider after it has been mounted to the zipper.

Turning now to the drawings, FIG. 3 depicts a plastic slider 30 prior to being folded and mounted to a zipper 32 of a reclosable plastic bag 34, while FIG. 4 depicts he slider 30 after it has been folded and mounted to the zipper 32. The bag 34 includes first and second opposing panels 34*a* and 34*b* fixedly connected to each other along three sides (not shown) to define a receptacle space accessed through a mouth of the bag.

Figure 6:
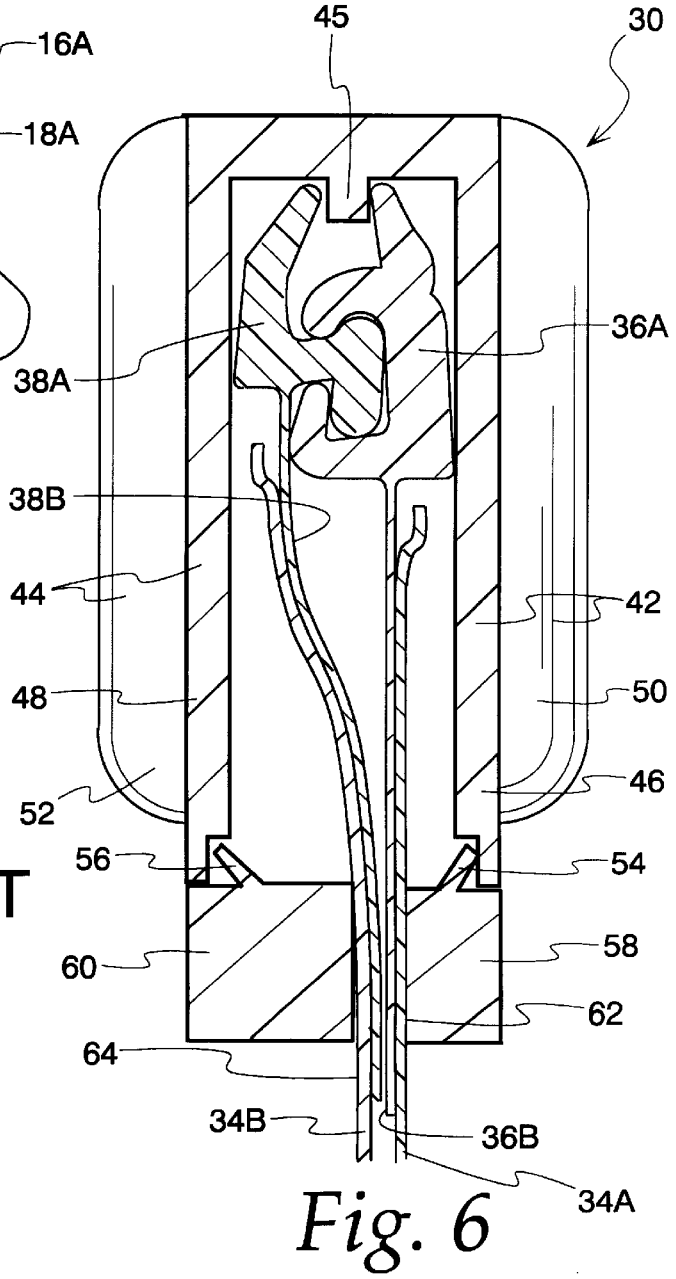
FIG. 6 is a section view taken generally along line 6—6 in FIG. 5.

Referring to FIGS. 3, 4, and 6, the zipper 32 extends along the mouth of the bag 34 and includes a female track 36*a–b* and a male track 38*a–b*. The female track 36*a–b* includes a female profile 36*a* and a first depending fin or flange 36*b* extending downward from the female profile 36*a*. Likewise, the male track 38*a–b* includes a male profile 38*a* and a second depending fin or flange 38*b* extending downward from the male profile 38*a*. If the zipper 32 is formed separately from the panels 34*a* and 34*b* of the bag 34, the first and second fins 36*b* and 38*b* are thermally fused to inner surfaces of the respective first and second panels 34*a* and 34*b*. Alternatively, the zipper 32 may be integrally formed with the panels 34*a* and 34*b* such that the first fin 36*b* is integrally formed with the first panel 34*a* and the second fin 38*b* is integrally formed with the second panel 34*b*.

To assist in opening and closing the zipper 32 of the plastic bag 34, the slider 30 is slidably mounted to the zipper 32 for movement between a closed position and an open position. FIG. 3 illustrates the slider 30 prior to being mounted on the zipper 32, while FIG. 4 illustrates the slider 30 after it has been mounted to the zipper 32. The slider 30 in its assembled position shown in FIG. 4 is used to engage and disengage the female and male profiles 36*a* and 38*a* of the zipper 32. The slider 30 has an opening end and a closing end. The slider 30 is wider at the opening end to allow separation of the female and male profiles 36*a* and 38*a*. The slider 30 is sufficiently narrow at the closing end to press the female and male profiles 36*a* and 38*a* into an interlocking relationship as the slider 30 is moved in a zipper closing direction.

The slider 30 is preferably composed of a single piece of molded plastic such as polycarbonate, polyester, nylon, polypropylene, polystyrene, Delrin or ABS. The assembled slider 30 is generally in the form of an inverted U-shaped member comprising a transverse support member 40 and a pair of side walls 42 and 44 extending downward from opposing sides of the support member 40. A separating finger 45 extends downward from the transverse support member 40 and, when the slider 30 is mounted to the zipper 32, the separating finger 45 disengages the female and male profiles 36*a* and 38*a* as the slider 30 is moved in a zipper opening direction. The side walls 42 and 44 of the slider 30 include respective legs 46 and 48 extending downward from the opposing sides of the support member 40. The side walls 42 and 44 also include respective wings 50 and 52 hingedly connected to the opposing sides of the support member 40. Prior to mounting the slider 30 to the zipper 32, the wings 50 and 52 are in the spread position depicted in FIG. 3.

To mount the slider 30 to the zipper 32, the slider 30 is placed over the zipper 32 with the separating finger 45 positioned between the female and male profiles 36*a* and 38*a* and the legs 46 and 48 positioned on opposite sides of the zipper 32. Thus, the zipper track 36*a–b* is disposed between the separating finger 45 and the slider leg 46, while the zipper track 38*a–b* is disposed between the separating finger 45 and the slider leg 48. With the slider 30 so positioned, the slider wings 50 and 52 are rotated downward about "living" hinges connecting the wings 50 and 52 to the opposite sides of the transverse support member 40. The wings 50 and 52 form central openings to receive the respective legs 46 and 48 when the wings 50 and 52 are folded downward.

The wings 50 and 52 are secured in their downward position depicted in FIG. 4 by a compression-type latch. More specifically, as best shown in FIG. 6, the wings 50 and 52 form respective flexible tongue latches 54 and 56 that engage the lowermost ends of the respective legs 46 and 48 to maintain the wings 50 and 52 in the downward position. Further details concerning the hinged structure of the wings 50 and 52 and the compression-type latch may be obtained from U.S. Pat. No. 5,448,808, which is incorporated herein by reference in its entirety. As an alternative to the slider 30 with the compression-type latch, it is contemplated that the slider could be made of a single solid piece of molded plastic without hinges.

Figure 7:
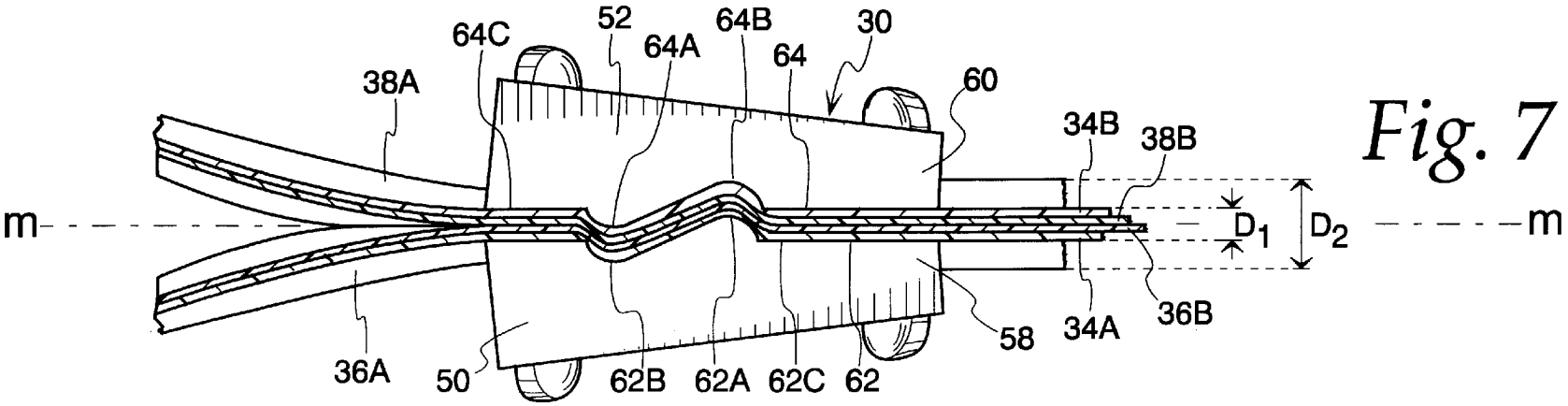
FIG. 7 is a section view taken generally along line 7—7 in FIG. 5.

Referring to FIGS. 6 and 7, with the slider 30 mounted to the zipper 32, the transverse support member 40 is adapted to move along the upper edges of the zipper profiles 36*a* and 38*a*. To retain the slider 30 on the zipper 32 and thereby prevent the slider 30 from being separated from or pried off the zipper 32, the wings 50 and 52 form respective first and second shoulders 58 and 60. The shoulders 58 and 60 extend inwardly toward each other and are positioned beneath the respective zipper profiles 36*a* and 38*a*. The shoulders 58 and 60 include respective innermost ends 62 and 64 that face and contact the respective bag panels 34*a* and 34*b* (or zipper fins 36*b* and 38*b*) below the respective interlocking profiles 36*a* and 38*a*.

Referring to FIG. 7, the innermost end 62 of the shoulder 58 includes a non-planar or undulating section having a protruding/convex portion 62*a* and a recessed/concave portion 62*b*. The protruding portion 62*a* juts further inward toward the adjacent zipper fin 36*b* than a remainder 62*c* of the innermost end 62 of the shoulder 58. The recessed portion 62*b* juts further away from the zipper fin 36*b* than the remainder 62*c* of the innermost end 62 of the shoulder 58. Likewise, the innermost end 64 of the shoulder 60 includes a non-planar or undulating section having a protruding/convex portion 64*a* and a recessed/concave portion 64*b*. The protruding portion 64*a* juts further inward toward the adjacent zipper fin 38*b* than a remainder 64*c* of the innermost end 64 of the shoulder 60. The recessed portion 64*b* juts further away from the zipper fin 38*b* than the remainder 64*c* of the innermost end 64 of the shoulder 60.

The non-planar section 62*a–b* of the innermost end 62 of the shoulder 58 is complementary to the non-planar section 64*a–b* of the innermost end 64 of the shoulder 60. Therefore, the protruding portion 62*a* opposes the recessed portion 64*b*, and the recessed portion 62*b* opposes the protruding portion 64*a*.

The non-planar sections 62*a–b* and 64*a–b* effectively increase the retention of the slider 30 on the zipper 32, thereby making it more difficult to remove the slider 30 from the zipper 32. As shown in FIGS. 4 and 6, the shoulders 58 and 60 are positioned beneath the zipper profiles 36*a* and 38*a*, and the zipper fins 36*b* and 38*b* and upper portions of the bag panels 34*a* and 34*b* are captured between the shoulders 58 and 60. As best shown in FIG. 7, the gap $D_1$ between the inwardly extending shoulders 58 and 60 is smaller than the distance $D_2$ between the outermost portions of the interlocking profiles 36*a* and 38*a*. The non-planar sections 62*a–b* and 64*a–b* create an S-shaped tortuous path through the gap $D_1$ that must be followed by the zipper fins 36*b* and 38*b* and the upper portions of the bag panels 34*a* and 34*b*. The protruding portions 62*a* and 64*a* preferably extend beyond a longitudinal mid-plane M dividing the slider 30 in half. The foregoing slider construction allows the slider 30 to essentially behave like a "zero" gap part, being very snug and very difficult to pry off the zipper 32. It is contemplated that the tortuous path noted above can be created only one protruding portion (akin to portion 62*a* or 64*a*) or by more than one protruding portion.

In a slider retention test, it was found that the slider 30 could easily withstand at least fifteen (15) pounds of pulling force for at least ten (10) second without coming off the zipper 32. Failure in the slider retention test did not occur until the pulling force reached more than about 25 pounds, at which point the slider 30 was separated from the zipper 32.

Figure 5:
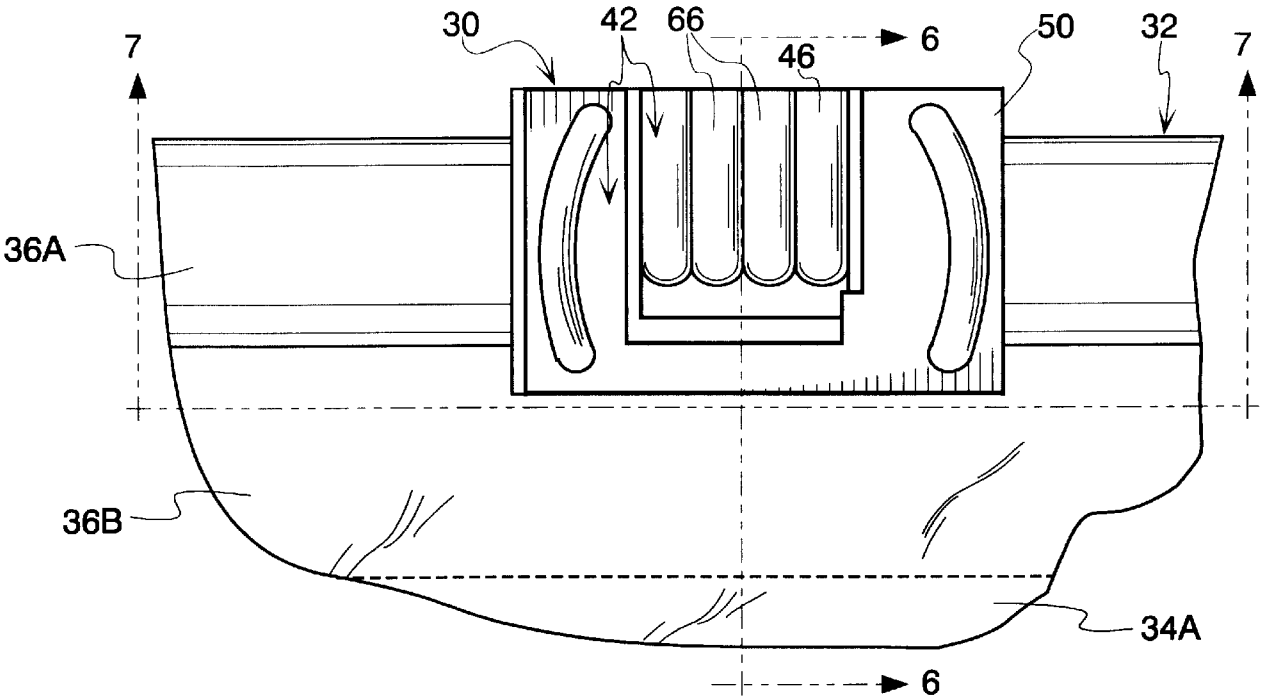
FIG. 5 is a side view of the slider.

In addition to the strong retention of the slider 30 on the zipper 32, the slider 30 is not easily disassembled once it is installed on the zipper 32 as shown in FIG. 4. To make it difficult to disassemble the installed slider 30, the legs 46 and 48 and wings 50 and 52 of the slider 30 are preferably ribbed as shown in FIGS. 4 and 5. The leg 46 forms a plurality of adjacent vertical reinforcement ribs 66, while the leg 48 forms a plurality of adjacent vertical reinforcement ribs 68 (hidden in FIG. 5). The ribs 66 and 68 are generally semicircular in cross-section and extend from an upper end to a lower end of the respective legs. The above slider construction minimizes flexing of the slider side walls 42 and 44 relative to the transverse support member 40 and increases the opening force required to unlatch the wings 50 and 52 from the respective legs 46 and 48.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A slider for straddling relation with a profiled plastic zipper of a reclosable bag, said zipper having first and second interlocking profiles, said straddling slider closing and opening the interlocking profiles by movement along the zipper, comprising:

a transverse support member; and a pair of side walls extending downward from opposing sides of said support member, said side walls forming respective first and second shoulders extending inwardly toward each other, said first and second shoulders including respective first and second innermost ends facing and contacting respective adjacent portions of the reclosable bag below the respective first and second interlocking profiles, said first innermost end forming a first protruding portion jutting further inward toward the respective adjacent portion of the reclosable bag than a remainder of said first innermost end and beyond a longitudinal mid-plane located between said side walls.

2. The slider of claim 1, wherein said first innermost end includes a first nonplanar section, said first non-planar section including said first protruding portion and a first recessed portion, said first recessed portion jutting further away from the respective adjacent portion of the reclosable bag than said remainder of said first innermost end.

3. The slider of claim 1, wherein said second innermost end forms a second protruding portion jutting further inward toward the respective adjacent portion of the reclosable bag than a remainder of said second innermost end and beyond said longitudinal mid-plane.

4. The slider of claim 3, wherein said second innermost end includes a second non-planar section, said second non-planar section including said second protruding portion and a second recessed portion, said second recessed portion jutting further away from the respective adjacent portion of the reclosable bag than said remainder of said second innermost end.

5. The slider of claim 1, wherein said side walls each include a plurality of generally adjacent vertical stiffening ribs for reinforcing said side walls and minimizing flexing of said side walls relative to said support member.

6. The slider of claim 5, wherein said side walls each include a leg and a wing, said wing being hingedly connected to said transverse support member and latched to said leg when said slider is installed on said zipper, said leg including said plurality of generally adjacent vertical stiffening ribs.

7. A slider for straddling relation with a profiled plastic zipper of a reclosable bag, said zipper having first and second interlocking profiles, said straddling slider closing and opening the interlocking profiles by movement along the zipper, comprising:

a transverse support member; and a pair of side walls extending downward from opposing sides of said support member, said side walls forming respective first and second shoulders extending inwardly toward each other, said first and second shoulders including respective first and second innermost ends facing and contacting respective adjacent portions of the reclosable bag below the respective first and second interlocking profiles, said first innermost end forming a first protruding portion and a first recessed portion, said first protruding portion jutting further inward toward the respective adjacent portion of the reclosable bag than a remainder of said first innermost end, said first recessed portion jutting further away from the respective adjacent portion of the reclosable bag than said remainder of said first innermost end, said second innermost end including a second non-planar section having a second protruding portion and a second recessed portion, said second protruding portion jutting further inward toward the respective adjacent portion of the reclosable bag than a remainder of said second innermost end, said second recessed portion jutting further away from the respective adjacent portion of the reclosable bag than said remainder of said second innermost end, said first non-planar section being complementary to said second non-planar section such that said first protruding portion opposes said second recessed portion and said first recessed portion opposes second protruding portion.

8. A slider for straddling relation with a profiled plastic zipper of a reclosable bag, said zipper having first and second interlocking profiles, said straddling slider closing and opening the interlocking profiles by movement along the zipper, comprising:

a transverse support member; and a pair of side walls extending downward from opposing sides of said support member, said side walls forming respective first and second shoulders extending inwardly toward each other, said first and second shoulders including respective first and second innermost ends facing and contacting respective adjacent portions of the reclosable bag below the respective first and second interlocking profiles, said first and second innermost ends defining an S-shaped tortuous path therebetween, said adjacent portions of the reclosable bag passing through said S-shaped tortuous path, said first innermost end forming a first protruding portion jutting further inward toward the respective adjacent portion of the reclosable bag than a remainder of said first innermost end.

9. A slider for straddling relation with a profiled plastic zipper of a reclosable bag, said zipper having first and second interlocking profiles, said straddling slider closing and opening the interlocking profiles by movement along the zipper, comprising:

a transverse support member; and a pair of side walls extending downward from opposing sides of said support member, said side walls forming respective first and second shoulders extending inwardly toward each other, said first and second shoulders including respective first and second innermost ends facing and contacting respective adjacent portions of the reclosable bag below the respective first and second interlocking profiles, said first and second innermost ends defining an S-shaped tortuous path therebetween, said adjacent portions of the reclosable bag passing through said tortuous path.

10. The slider of claim 9, wherein said tortuous path is created by protrusions formed by at least one of said innermost ends.

11. The slider of claim 9, wherein said tortuous path is created by protrusions and recesses formed by at least one of said innermost ends.

12. The slider of claim 9, wherein said tortuous path is created by protrusions formed by said innermost ends.

13. The slider of claim 9, wherein said tortuous path is created by protrusions and recesses formed by said innermost ends.

14. The slider of claim 9, wherein said side walls each include a plurality of generally adjacent vertical stiffening ribs for reinforcing said side walls and minimizing flexing of said side walls relative to said support member.

15. The slider of claim 14, wherein said side walls each include a leg and a wing, said wing being hingedly connected to said transverse support member and latched to said leg when said slider is installed on said zipper, said leg including said plurality of generally adjacent vertical stiffening ribs.

16. A slider for straddling relation with a profiled plastic zipper of a reclosable bag, said zipper having first and second interlocking profiles, said straddling slider closing and opening the interlocking profiles by movement along the zipper, comprising:

a transverse support member; and a pair of side walls extending downward from opposing sides of said support member, said side walls forming respective first and second shoulders extending inwardly toward each other, said first and second shoulders including respective first and second innermost ends, said first innermost end forming a first protruding portion jutting further inward toward the respective adjacent portion of the reclosable bag than a remainder of said first innermost end, said first and second innermost ends directly facing and contacting respective adjacent portions of the reclosable bag with no portion of said slider interposed between said respective adjacent portions, said respective adjacent portions of the reclosable bag being adjacent to each other along the entire length of said slider.

17. A slider for straddling relation with a profiled plastic zipper of a reclosable bag, said zipper having first and second interlocking profiles, said straddling slider closing and opening the interlocking profiles by movement along the zipper, comprising:

a transverse support member; and a pair of side walls extending downward from opposing sides of said support member, said side walls forming respective first and second shoulders extending inwardly toward each other, said first and second shoulders including respective first and second innermost ends facing and contacting respective adjacent portions of the reclosable bag below the respective first and second interlocking profiles, said first innermost end forming a protrusion for at least part of its length, said second innermost end forming a recess for at least part of its length, said protrusion opposing said recess.

* * * * *